United States Patent [19]

Daidola et al.

[11] 3,996,138

[45] Dec. 7, 1976

[54] MARINE LIFE PROTECTOR

[76] Inventors: Ernest Daidola; John C. Daidola, both of 39 Kilburn Ave., Huntington Station, N.Y. 11746

[22] Filed: Aug. 2, 1974

[21] Appl. No.: 494,125

[52] U.S. Cl. ..... 210/170; 61/21

[51] Int. Cl.[2] ..... E02B 15/04

[58] Field of Search ..... 210/170, 172, 162 (154), 210/460, 117; 137/236, 171, 172, 247.33, 247.35; 61/17, 21

[56] References Cited

UNITED STATES PATENTS

| | | | |
|---|---|---|---|
| 5,920 | 6/1774 | Meyer | 210/170 |
| 152,449 | 6/1974 | Young | 210/460 |
| 164,024 | 6/1975 | Naughten | 210/117 |
| 238,439 | 3/1881 | Roberts | 210/170 |
| 254,364 | 2/1882 | O'Grady | 137/247.33 X |
| 268,865 | 12/1882 | Cosell | 137/247.33 |
| 623,782 | 4/1899 | Hammett | 210/170 |
| 975,450 | 11/1910 | Ouimet | 210/170 |
| 1,070,773 | 8/1913 | Callahan | 137/247.35 |
| 1,207,002 | 12/1916 | Doble | 137/236 |
| 1,526,637 | 2/1925 | Hess | 137/247.33 X |
| 1,793,599 | 2/1931 | Egan | 210/170 |
| 2,361,231 | 10/1944 | Nebolsine | 210/170 |
| 2,732,071 | 1/1956 | Crow | 210/172 X |
| 3,313,417 | 4/1967 | Rosaen | 210/172 X |
| 3,638,796 | 2/1972 | Tuggle | 210/170 |
| 3,815,742 | 6/1974 | Dubouchet | 210/154 |
| 3,820,342 | 6/1974 | Stipanov | 61/21 |

*Primary Examiner*—Theodore A. Granger
*Attorney, Agent, or Firm*—David H. Semmes

[57] ABSTRACT

A device for protecting marine life from water intake ducts is presented. The intake duct enters the marine life protector which is characterized as an inner body of water separated from the main outer body of water by means of barrier walls. Through one or more of these barrier walls, input ducts are arranged which pass through the barrier walls having their longitudinal axes other than parallel to the free surface of the water bodies so that the input and exit orifices of the ducts are at different water levels. At least one of these orifices may be covered with a grating or screening or other additional protective means.

14 Claims, 6 Drawing Figures

MARINE LIFE PROTECTOR

BACKGROUND OF THE INVENTION

This invention relates to the problem of ingestion of fish and other marine and aquatic life by suction, random entry, or other means into intakes. An example of such a situation exists in the electric power generating field today. Whether oil-fired, coal-fired, or atomic, in their present configuration, power plants use water from nearby water sources for cooling purposes. This causes several unfavorable effects, one of which is the ingestion of fish and other marine and aquatic life into the cooling system water intakes by suction, random entry, or other means. The same problem can exist in any situation where water or materials in the water are required for some purpose and are obtained from water bodies containing marine life.

PRIOR ART

Restriction of marine life against free and unencumbered movement, generally, is known. For example, U.S. Pat. Nos. 450,490 (McElroy) and 1,451,394 (Hurst) disclose screens to guard against fish ingestion or discharge from a fish preserve dam and from irrigation systems. U.S. Pat. No. 894,339 (Niemeier) shows an inlet box for drainage of meadowland or marsh systems. Further U.S. Pat. Nos. 1,585,409 (Myers) and 2,361,231 (Nebolsine) show various means for impounding or screening the water which has been impounded.

SUMMARY OF THE INVENTION

The principal object of this invention is to provide a device designed to prevent fish and other marine aquatic life from being ingested by suction, random entry, or other means into water intakes of all kinds. A further object of this invention is to provide a marine life protector which, in and of itself, presents no harmful effects on the environment.

A still further object of the present invention is to provide a device for the protection of marine life requiring no power for its operation.

A still further object of the present invention is to provide a device for the protection of marine life which presents no harm to other forms of life.

Other objects and advantages of this invention will become apparent from the following description taken in connection with the accompanying drawings wherein are set forth by way of illustration and example certain embodiments of this invention.

Figure 1:
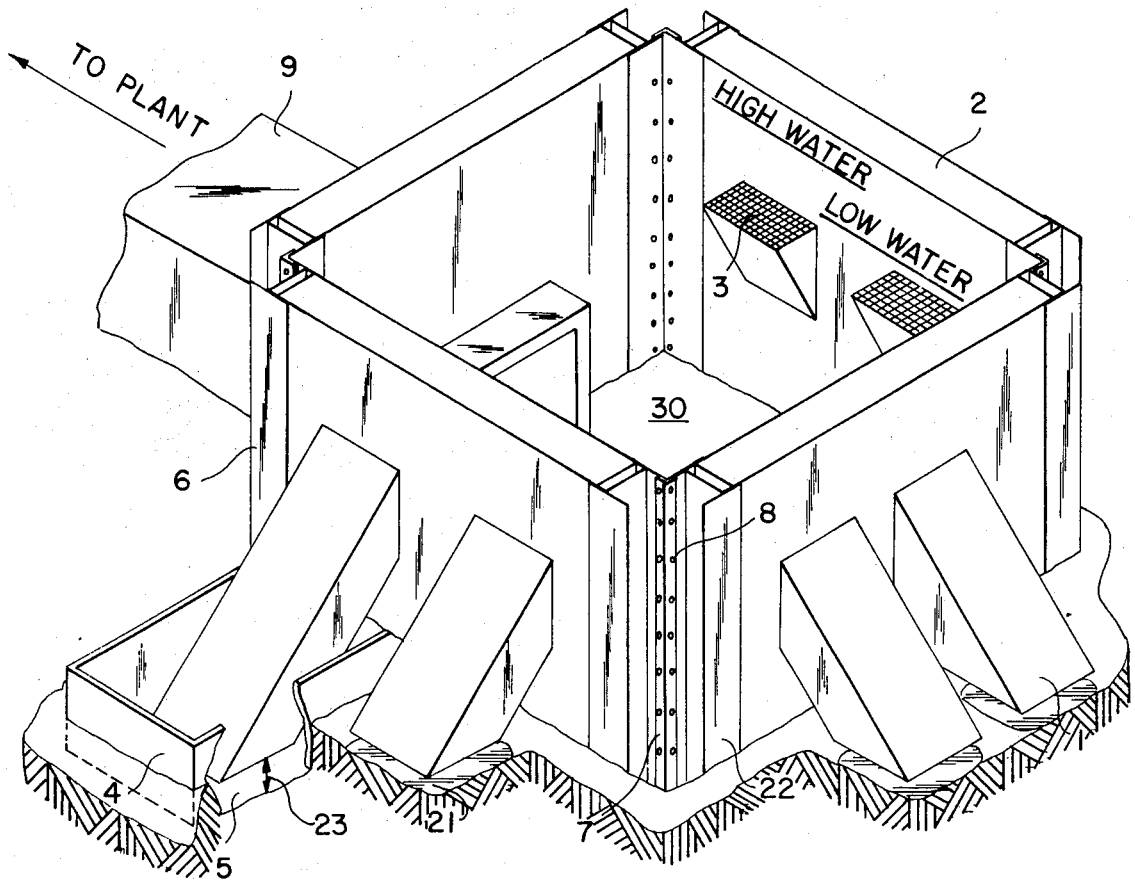
FIG. 1 represents a corner elevational view of the marine life protector characterized as having a trench and wall surrounding the base of an input duct.
Figure 6:
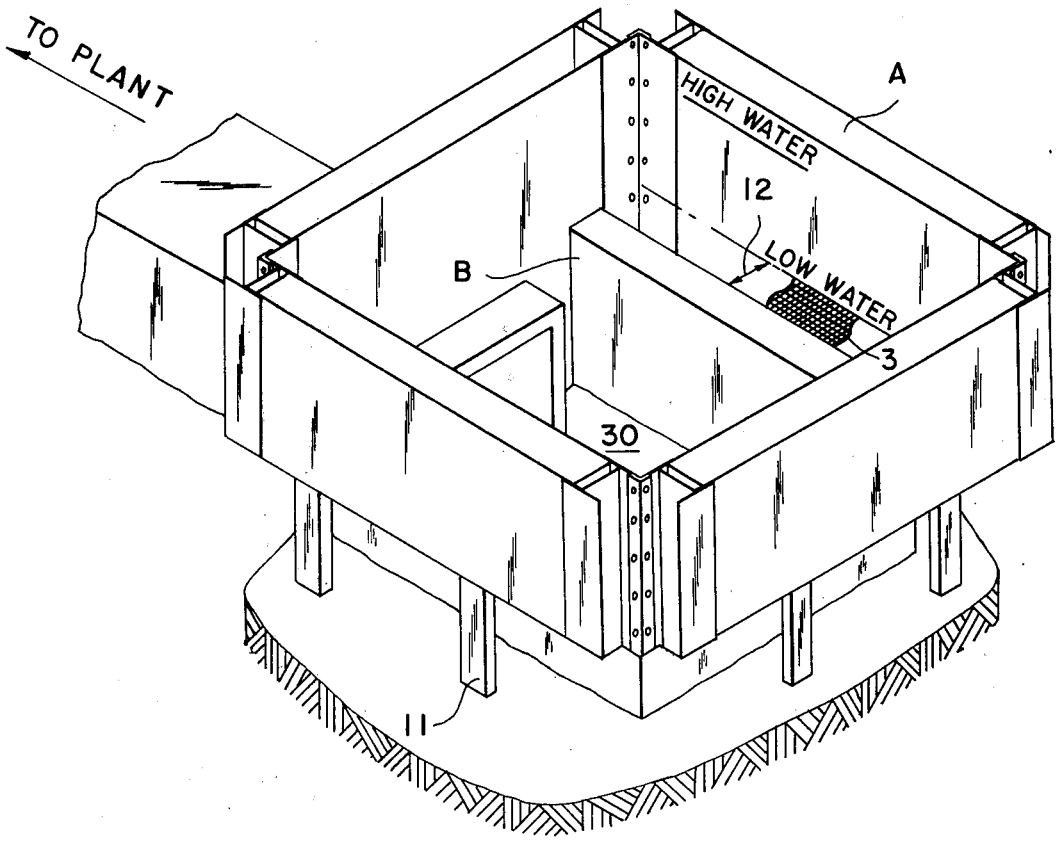

FIG. 6 represents a corner elevational view of a marine life protector of the present invention in which input ducts have been replaced by parallel barrier surfaces that act as "effective input ducts". DESCRIPTION OF PREFERRED EMBODIMENTS FIG. 1 shows a typical configuration of the marine life protector of the present invention. As shown, barrier walls 2 are so arranged as to form enclosed area 30. Entering enclosed area 30 are input ducts 1 depicted as rectangular orifices diagonally projecting from the barrier walls from a point slightly below the lowest anticipated water level to a point slightly above the floor of the water body at a clearance 21. The clearance below each duct is illustrated by shading, as at 21 in FIG. 1 to further illustrate that the orifice is slightly above and substantially parallel to the floor. Additionally, the floor of the water body is schematically illustrated in partial section to simply represent either mud, or other type of normal water bottom composition. Further entering barrier wall 2 is intake duct 9 shown in this embodiment also to be a tubular orifice of rectangular cross section. As further illustrated in FIGS. 1–3, each input duct has an orifice at each end which is essentially of a planar opening configuration. These input duct openings allow water to pass into the duct and then into enclosure defined by barrier walls 6. The planar openings at 23, in FIG. 1, are substantially parallel to the floor and likewise the other end of the input ducts, at 3, are also of a planar opening configuration that is parallel to the floor. An additional inhibiting means 3 may be placed across the orifice shown in FIG. 1 to be a screen or grating. The actual configuration of such additional inhibiting means will be governed by the nature and variety of marine life to be excluded from the intake duct.

The marine life protector (M.L.P) can be constructed in many ways with cement, steel, aluminum or any other material, ferrous or non-ferrous. As an example, the particular configuration in FIG. 1 may consist of pre-cast steel reinforced ducting 1, which is then inserted into a mold for the barrier 2, which is then cast with steel reinforced cement. As shown, the I-beams may constitute corner structures, so that the concrete barrier walls simply extend from between the flanges of each corner I-beam assembly. A section of the intake duct 9 can also be cast with the barrier 2 in the same fashion. Steel I-beams 6 are hammered or are inserted in some other fashion into the water body bottom and two adjacent I-beams are connected by the angle 7 and rivets 8. The pre-cast barrier and ducting combination can then be lowered into the I-beams between the I-beam flanges. Further, the actual shape and inclination of the barrier need not be restricted in any fashion but can be governed by esthetics of functional design to be, the rectangle, as shown, or virtually any other configuration which would functionally separate the enclosed body of water within area 30 from the main water body. Further, input duct 1 and plant intake duct 9 need not be of a rectangular or square cross section but may be of any configuration which performs the function outlined herein.

In operation, the water within area 30 will be of equal height to that of the main water body. The intake duct 9 will take water from the space 30. If the barrier did not exist, fish and other marine and aquatic life would be swept along with the water and ultimately killed at the point of destiny of the water. As the water within the space enclosed by barrier 2 is removed by duct 9, water is replenished through input ducting 1 to keep the water surface level within and without the barrier at the same vertical level. Although the velocity of water in the intake duct 9 is usually high when compared with that which is safe to protect fish and other marine and aquatic life from eing swept away, by making the number and size of input ducts 1 of appropriate area, the velocity of water flow through input ducting 1 can be reduced to any desired level even though that of duct 9 is high. Therefore, it can be seen that a primary advantage herein is that the velocity of water through the plurality of input ducts, may be maintained significantly less than the required water velocity through the ultimate water intake, 9. The absolute maximum velocity through input ducting 1 will depend on the local terrain and type of fish and marine and other aquatic life in the vicinity that the M.L.P. is to be utilized. Therefore, the same M.L.P. configuration could have a different number of ducts of different cross-sectional area for different geographic locations.

It is known that many fish and other marine and aquatic life live primarily at a certain general depth of water. Therefore, placing input ducting 1 at an inclination will preclude the possibility of fish and other marine and aquatic life from randomly entering, wandering, or chasing other life through input ducting 1. For example, a fish which lives near the water surface will not wander down to the input duct 1 entrance at the bottom outside barrier 2, and the fish at the bottom will not be inclined to swim from the open end of input duct 1 up to the top of the inside of the space enclosed by barrier 2. Further precluding the possibility of fish or other marine and aquatic life from wandering into the space 30, is the use of inhibiting means shown as a screen or grating 3. Also, the velocity through the duct can be made small enough that impingement of the fish or other marine life and aquatic life on the screen or grating would be impossible. With the location of the screen or grating in FIG. 1, repair and maintenance would be very simple with the use of a small boat or other craft at low tide.

Additional features may also be employed in order to preclude the possibility of fish or other marine and aquatic life from wandering into space 30. These are shown in FIG. 1 by wall 4 and trench 5, with a footing for wall 4, into the bottom, illustrated in dotted line. If a trench is dug in the water body bottom, input ducting 1 can extend below the bottom so that fish and other marine and aquatic life would have to go below the water body bottom into a restricted trench before entering input ducting 1. The trench would have to be large enough to allow proper flow of water down to the input duct entrance. Also proper clearance should be kept between the entrance of the duct and the trench bottom 23. Further, wall 4 would also further obstruct movement. Wall 4 and trench 5 can be used in combination as shown in FIG. 1 or separately while still performing their intended functions.

Figure 2:
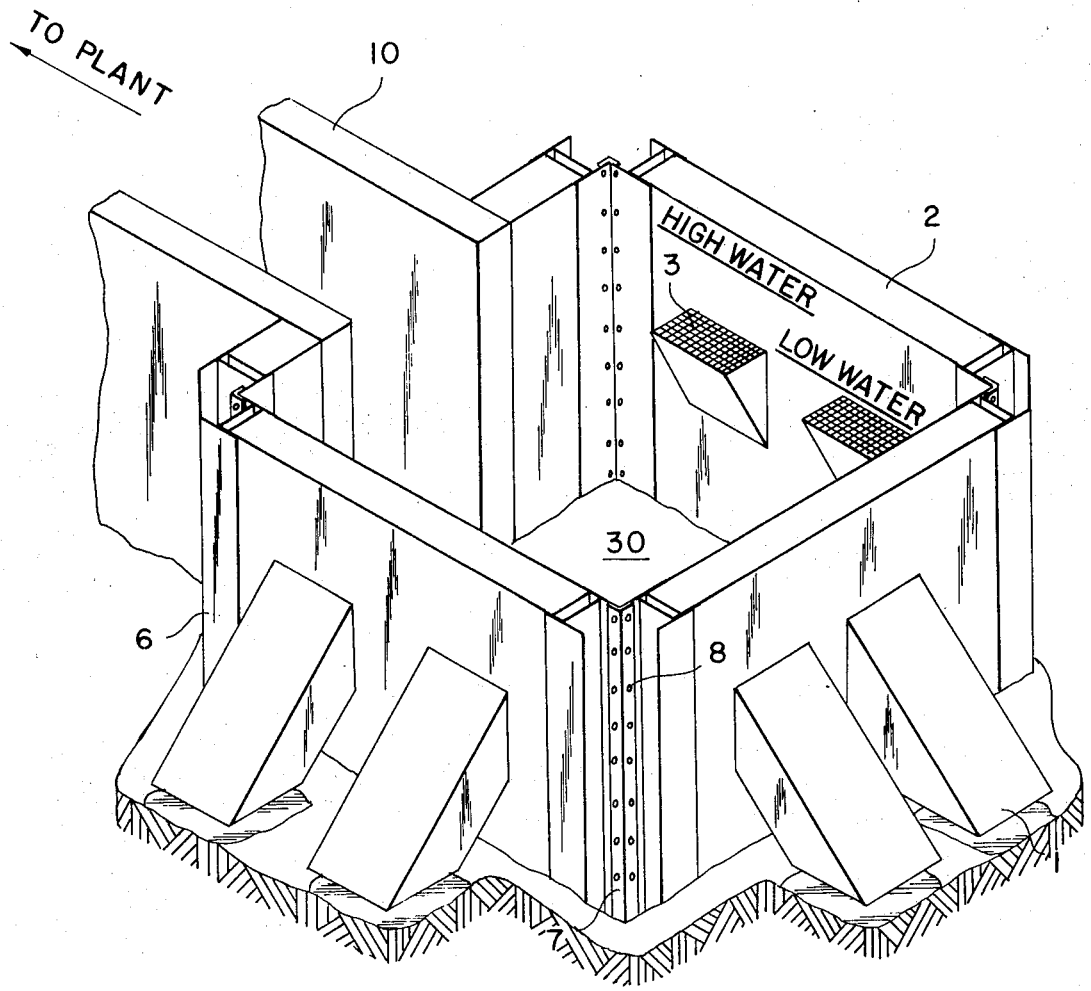
FIG. 2 is a corner elevational view of the marine life protector in which the intake duct is open to the atmosphere.

FIG. 2 differs from FIG. 1 in showing intake duct 10 of the open channel type, with the top open to the atmosphere and with side walls extending above the water body surface, even for the highest possible water level. This duct can extend to the water body bottom or can terminate at some point below the lowest expected water body level.

Figure 3:
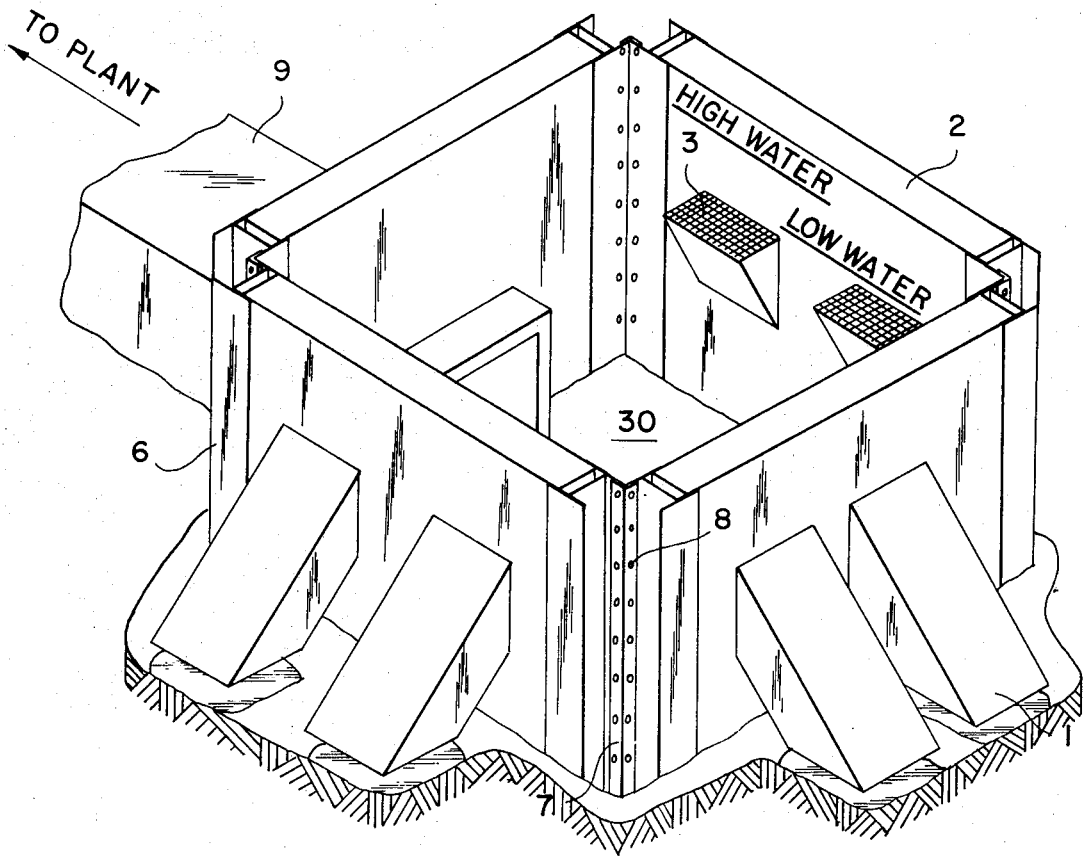
FIG. 3 is a corner elevational view similar to FIG. 1 without the wall and trench embodiment.

FIG. 3 is similar to FIG. 1 with the trench 5 and wall 4 removed. Note that intake duct 9 is again of the closed variety, thus distinguishing FIG. 3 from the embodiment shown in FIG. 2.

Figure 4:
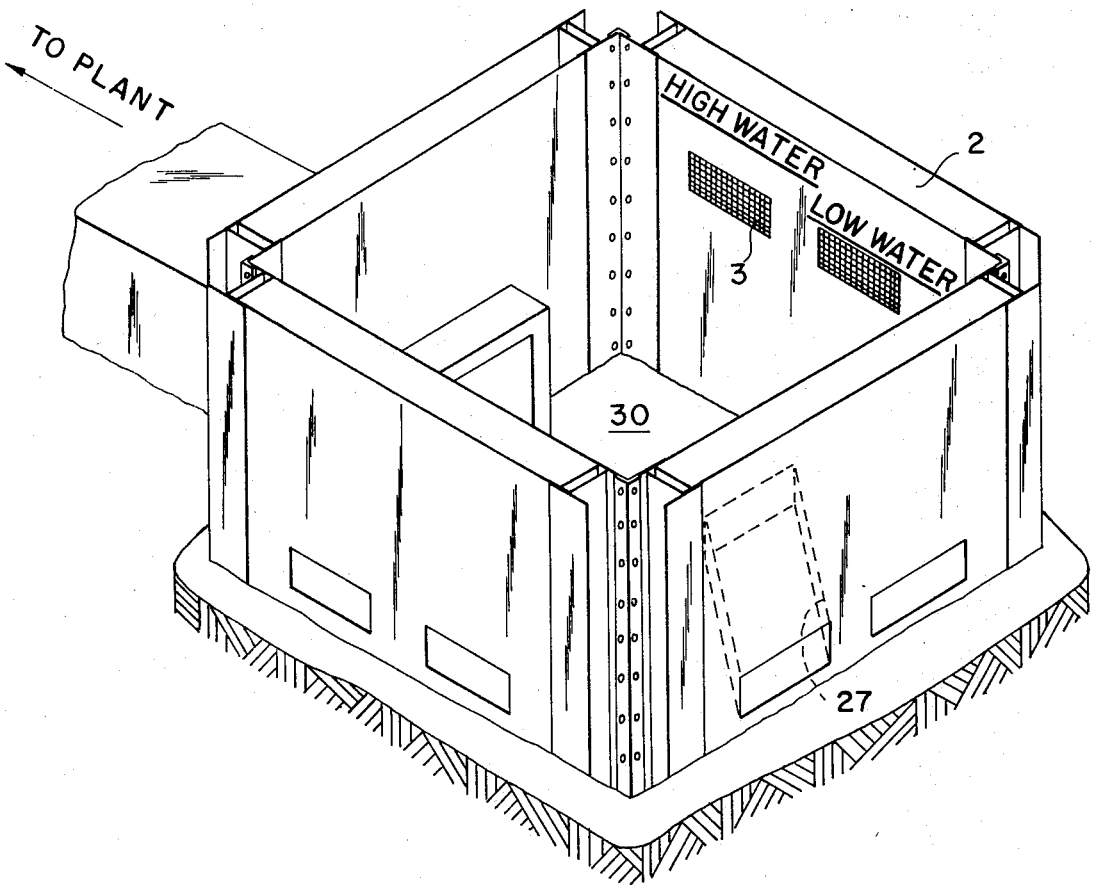
FIG. 4 is still another marine life protector in which the input ducts are completely within the barrier wall structure.

FIG. 4 shows a M.L.P. with input ducting 27 within barrier 2. This may be done, for example, by casting a steel reinforced cement barrier 2 with a void of the size and shape of the required design input ducting. Although said input ducting is completely within barrier 2 in this embodiment, input duct 27 remains at a diagonal and thus functions as input ducting 1 of the previous figures. Further, grating 3 can be built into barrier 2 being completely parallel and flush to the inner wall surface.

Figure 5:
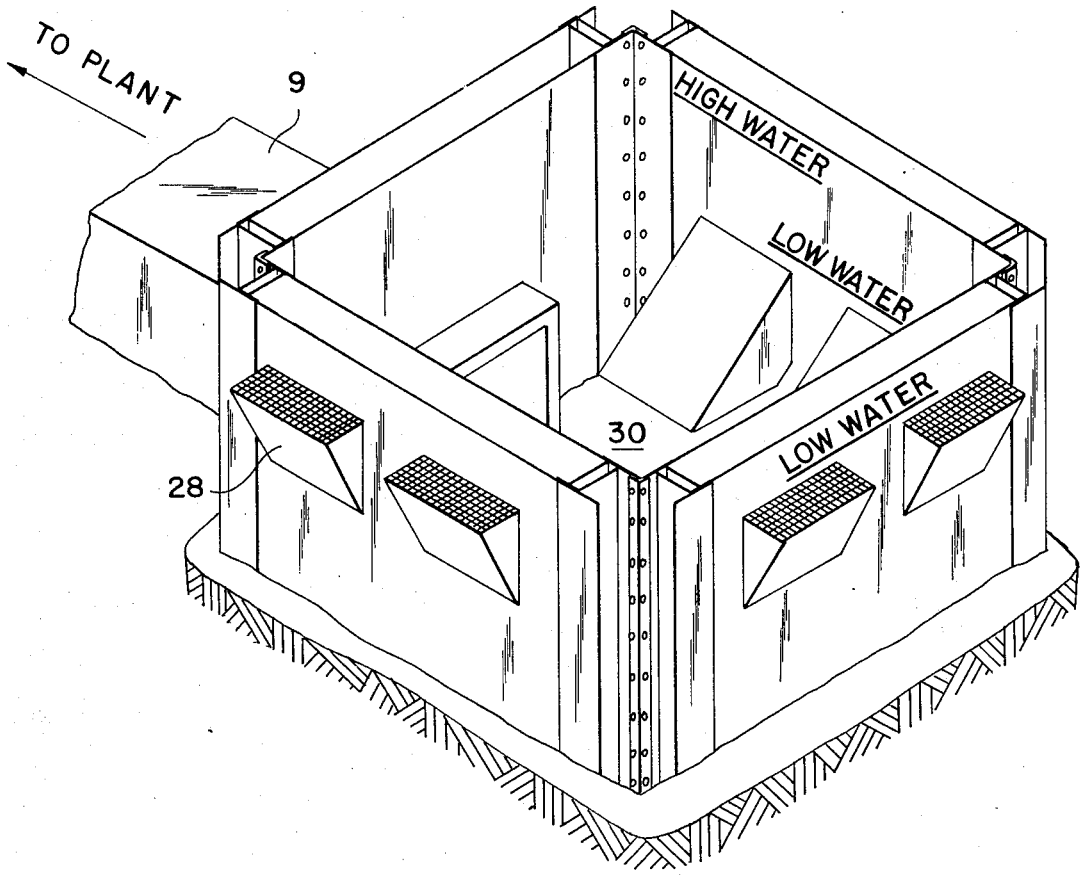
FIG. 5 represents yet another corner elevational view as in FIG. 3, with the input ducts rotated 90°.

FIG. 5 shows a M.L.P. similar to that of FIG. 3, but with input ducting 28 moved 90° from that shown in the prior recited figure. As in the other embodiments, the upper orifice of input ducting 28 must be below the lowest anticipated water level so that intake 9 does not exhaust water supply in area 30.

FIG. 6 shows an M.L.P. with an "effective input duct" in that the two part barrier A and B forms a vertical channel of width 12. This channel is like a wide input duct and the same mechanisms of operation as previously discussed are incorporated. The two barriers A and B can be precast of steel reinforced cement or made of other material and the outer barrier supported by legs 11 of steel reinforced cement, steel, or other material which are driven or inserted in some other manner into the water body bottom to afford rigid support of the barrier. Additional inhibiting means 3 (grating or screen shown) can be the same as that used in the other configurations shown and covers width 12 and thus further impedes movement of marine or aquatic life into area 30.

It is to be understood that while certain forms of this invention have been illustrated and described, it is not to be limited to the specific form, arrangement of parts, or construction material herein described and shown except insofar as such limitations are included in the claims.

We claim:

1. A marine life protector for preventing marine life from entering the water intake of a power plant, said protector device comprising:

A. first barrier walls defining an enclosure for water to be supplied to a water intake wherein lower edges of said first barrier walls are sealingly connected to the floor of a body of water and extending upwardly to upper edges of said first walls; and, B. second barrier walls circumferentially spaced around and outwardly from said first barrier walls, the lower edges of said second walls being spaced both above said floor and below the upper edges of said first walls, and C. power plant water intake means extending outwardly from at least one of said first barrier walls for fluid communication of said enclosure with a power plant whereby marine life external to said protector is excluded from water entering said enclosure by said water passing first under the lower edge of said second barrier walls, then over the upper edges of said first barrier walls.

2. The marine life protector of claim 1 with additional inhibiting means extending throughout the area defined by the space between said first barrier walls and said outwardly spaced second barrier walls.

3. The marine life protector device of claim 2 in which said inhibiting means is a screen or grate.

4. A marine life protector device for preventing marine life from entering the water intake of a power plant, said protector device comprising:

A. barrier walls extending upwardly from the floor of a body of water to define an enclosure therewithin, wherein lower edges of said walls are sealingly connected to said floor and upper edges extend upwardly to a point which is above the highest anticipated water level point of said body of water; and B. at least one input duct means, said duct having a longitudinal flow axis and further including a first planar water input duct opening configuration at one end of said duct, said duct extending diagonally through said barrier wherein said first planar configuration at said one end of said input duct is located outwardly from said enclosure, wherein further i. said first planar input duct opening configuration is located slightly above and substantially parallel to said floor, and ii. the other end of said input duct opens into said enclosure and includes a second planar input duct opening configuration that is both substantially parallel to said floor and spaced proximate upper edges of said barrier walls, whereby water is permitted to enter said first end of said input duct and flow into said enclosure, while excluding marine life; and, C. water intake means extending through at least one of said barrier walls proximate said lower edges, for communicating water within said enclosure to said power plant.

5. The marine life protector of claim 4 having at least one input duct possessing additional inhibiting means to prevent the passage of marine life.

6. The marine life protector device of claim 5 in which said inhibiting means is a screen or grate.

7. The marine life protector device of claim 4 in which a second wall extends upwardly from said main body floor and surrounds the first planar opening of said duct means.

8. The marine life protector device of claim 4 in which said floor of the main water body includes a surface defining a trench which surrounds the first planar opening of said duct means.

9. The marine life protector of claim 4 in which said floor of the main water body includes a surface defining a trench, which surrounds the first planar opening of said input duct, and said first planar opening extends below the main water body bottom to a point slightly above the surface defining the trench bottom.

10. The marine life protector of claim 9 in which a second wall extends upwardly from said main water body floor and surrounds the surface defining said trench.

11. The marine life protector device of claim 4 in which said water intake means is an upwardly closed duct, at least a portion of said intake duct being below the upper edge of said barrier walls.

12. The marine life protector device of claim 4 in which said water intake means is an upwardly open duct, at least a portion of said intake duct below the upper edge of said barrier walls.

13. The marine life protector of claim 4 in which said barrier walls and duct means are comprised of steel reinforced cement.

14. The marine life protector of claim 13 in which said barrier walls define an enclosed space by means of I-beam supports vertically positioned at the intersecting corners of four rectangularly disposed barrier walls.

* * * * *